US006082919A

United States Patent [19]

de Laforcade

[11] Patent Number: 6,082,919

[45] **Date of Patent: *Jul. 4, 2000**

[54] ASSEMBLY FOR THE APPLICATION OF A FLUID OR SEMI-SOLID PRODUCT ONTO A SURFACE

[75] Inventor: Vincent de Laforcade, Rambouillet, France

[73] Assignee: L'Oreal, Clichy, France

[ * ] Notice: This patent is subject to a terminal disclaimer.

[21] Appl. No.: 09/159,563

[22] Filed: Sep. 24, 1998

Related U.S. Application Data

[63] Continuation of application No. 08/748,796, Nov. 14, 1996, Pat. No. 5,876,139.

[30] Foreign Application Priority Data

Nov. 23, 1995 [FR] France ..... 95 13939

[51] Int. Cl.[7] ..... A46B 11/02

[52] U.S. Cl. ..... 401/190; 401/205

[58] Field of Search ..... 401/190, 205, 401/206, 175, 49, 148, 196

[56] References Cited

U.S. PATENT DOCUMENTS 2,737,677 3/1956 Pasulka ..... 401/205
4,747,720 5/1988 Bellehumeur et al. ..... 401/205

FOREIGN PATENT DOCUMENTS 2240032 7/1991 United Kingdom ..... 401/205

*Primary Examiner*—David J. Walczak
*Attorney, Agent, or Firm*—Oblon, Spivak, McClelland, Maier & Neustadt, P.C.

[57] ABSTRACT

An assembly for the application of a product includes a container (104) which contains a product to be dispensed and is provided with an outlet for the product, and a component (114) for applying the product, which has an application surface (118) and a peripheral edge (122). The component includes a region (126) in communication with the product outlet of the container. The application component comprises a part (127), separate from the application component, which limits the radial diffusion of the product in the application component, this part being located between the region and the peripheral edge of the application component.

16 Claims, 3 Drawing Sheets

ASSEMBLY FOR THE APPLICATION OF A FLUID OR SEMI-SOLID PRODUCT ONTO A SURFACE

This application is a Continuation of application Ser. No. 08/748,796, filed on Nov. 14, 1996, now U.S. Pat. No. 5,876,139.

BACKGROUND OF THE INVENTION

1. Field of the Invention

The invention relates to an assembly for the application of a fluid or semi-solid product onto a surface to be treated. The application assembly may, in particular, be used in the cosmetics field for the application of a deodorant, in the pharmaceuticals field for the application of insect repellents, as well as in the fields of adhesives, paints or polishes. More especially, this application assembly is intended for the application of a body deodorant.

2. Description of the Related Art

FR-A-2,713,060 describes an application assembly which comprises a pressurized product container provided with a dispensing valve and an application component which includes a porous dome and is fixed onto the container. This dome is held by a support connected mechanically to a collar fixed onto the container. When this assembly is applied to the surface to be treated, the porous dome becomes impregnated with product, first in that portion of the dome lying along the outlet axis of the container, then in the remainder of the dome as the product diffuses into the other cavities in the dome. After the product has been applied to the surface to be treated, the dome remains impregnated with product, in particular when the latter has a fairly thick consistency or has low volatility.

When the application assembly is used for the second time, the product emerging from the container presses out the product remaining in the dome. Thus, the remaining product then spreads over the entire surface of the dome; the product therefore accumulates on the surface of the dome and an excessive quantity of product is released from the dome. When the product is liquid, it will flow off the dome and soil the container. When it is of thicker consistency, accumulations of product form on the surface of the dome. These surpluses of product make the use of an application assembly of this type problematic.

SUMMARY OF THE INVENTION

It is therefore an object of the present invention to remedy the drawbacks mentioned above.

It is a further object of the invention to provide an application assembly which prevents excessive dispensing of product over the entire surface of the application component.

The applicant has unexpectedly and surprisingly discovered that such a result could be obtained by limiting the radial diffusion of the product in the application component.

The above and other objects are therefore achieved by an assembly for the application of a product, comprising a container which contains a product to be dispensed and is provided with an outlet for the product; and a component for applying the product, which has an application surface and a peripheral edge, the component including a region in communication with the product outlet of the container. The application component comprises a part, separate from the application component, which limits the radial diffusion of the product in the application component, this part being located between the said region and the peripheral edge of the application component.

Advantageously, the part which limits the radial diffusion of the product in the application component comprises a wall placed around the region in communication with the product outlet of the container. Preferably, the wall is in the form of a cylinder arranged substantially along an axis X of the container, and centred on this axis, so as expediently to limit the radial diffusion of the product in the application component. The wall may be continuous or discontinuous.

Advantageously, the wall may, in its upper portion, be radially extended relative to the axis X by a plate which lies in a plane substantially perpendicular to the axis X and extends towards the peripheral edge of the application component and which has a lower face directed towards the container. This plate is preferably in proximity to the application surface, which makes it possible to reduce the internal volume of the application component impregnated with product and to direct the product towards the application surface. Thus, little product will reach the peripheral edge of the application component, thereby limiting soiling.

In particular, the minimum distance d between the part and the application surface is less than or equal to 5 mm.

Furthermore, in its lower part, the plate may include at least one holding skirt which makes it possible to support the application component well, in particular when the product is applied to the surface to be treated.

Advantageously, the application component may be carried by a support. In particular, the above-mentioned part may be secured to the support, which makes the application assembly easier to fit together.

The peripheral edge of the application component may be a lateral surface made of the same material as the application surface of the component. Thus, the external surface of this component is made of a single material, ensuring continuity between the lateral surface and the application surface.

Furthermore, the application assembly may comprise means for connecting the application component to a collar fixed onto the container, which makes the assembly easier to manipulate by the user and gives functional flexibility. These connection means may consist of one or more regularly distributed flexible tongues between the application component and the collar.

When the application component is carried by a support, these connection means may be provided between this support and the collar.

Furthermore, the container of the assembly according to the invention may comprise means for compressing the product, which can produce a sufficient pressure on the product to press it through the application component. However, the container could be a bottle or a flexible tube actuated by hand.

In a first alternative embodiment, the compression means may include a propellent gas and a dispensing valve provided with a hollow valve rod including a product inlet and outlet. In this case, the application component may be fixed directly onto the hollow valve rod. When the application component comprises a support, the latter may be fixed to the hollow valve rod. The hollow rod, and optionally the support, mechanically connect the application component to the container.

In a second alternative embodiment, the compression means are of the mechanical type and may include a piston associated with a means for operating the piston. This operating means may consist of a rotatable rod provided with a screw thread and secured to an actuation element such as a knurled wheel or a handle, the screw thread of the rod interacting with a complementary screw thread made in the piston. In this alternative embodiment, the application component part may be fixed onto the container.

Advantageously, the application component may be made of a rigid or deformable material. For example, the application component may be an open-celled foam, a sponge or, preferably, a sintered part. The application component preferably has the shape of a dome with a substantially convex or plane application surface.

The application assembly is entirely suited to the dispensing of a body deodorant. Thus, the present invention further provides an applicator assembly for body deodorant which consists of an application assembly as defined above.

BRIEF DESCRIPTION OF THE DRAWINGS

Apart from the arrangements referred to above, the invention consists of a number of other arrangements which will be explained below with regard to non-limiting illustrative embodiments which are described with reference to the accompanying drawings in which.

DETAILED DESCRIPTION OF THE PREFERRED EMBODIMENTS

Figure 1:
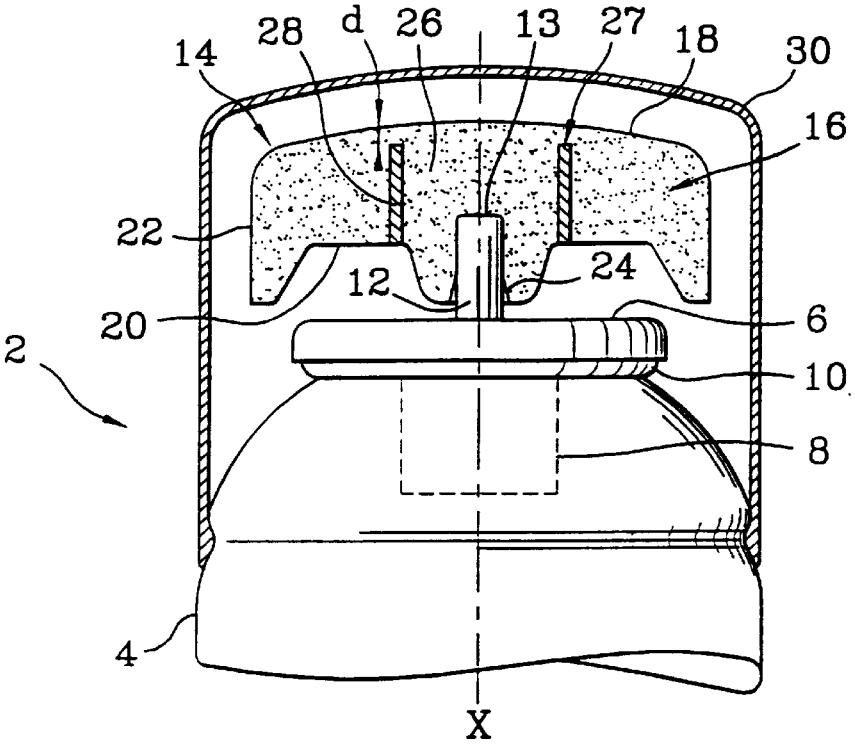
FIG. 1 is an axial section of an application assembly according to a first embodiment of the invention.

Referring to the accompanying FIG. 1, an application assembly is shown, denoted overall by the reference 2, having an axis of symmetry X and including a generally cylindrical container 4 pressurized using a propellent gas. At its upper end, this container carries a valve dish 6 fixed to the container by a crimped bead 10. Along the axis X, the valve dish 6 carries the dispensing valve 8 which, in the case of the present example, is a male valve having a protruding hollow rod 12. This valve is a tilt valve which is opened by tilting the rod 12 laterally, or may be an axially depressed valve.

The container contains a liquid or pasty product to be dispensed, for example a cosmetic such as a deodorant, perfumery, hair-removing or slimming product. The end 13 of the hollow rod 12 is used as an outlet for the product contained in the container 4.

The application assembly furthermore comprises an application component 14 which includes a porous dome 16 made of sintered material, provided with an application (or upper) surface 18 which is slightly curved, convexly outwards. This dome also includes a lower surface 20 forming an annular plane part perpendicular to the axis X. It also includes a cylindrical lateral surface 22 with a symmetry of revolution about the axis X. At its center along the axis X, the lower surface 20 includes a bore 24 allowing forcible insertion of the free end 13 of the hollow valve rod 12. The dome also includes a region 26 in communication with the product outlet of the container 4, i.e., with the end 13 of the valve rod 12. This region lies above the bore 24 along the axis X, and is bounded by a part 27 comprising a wall 28 in the form of a cylinder centered on the axis X and open at its ends. This continuous wall is embedded in the porous dome. However, regularly distributed cylinder segments could have instead been used.

The minimum distance d between the part 27 and the external application surface 18 is, for example, equal to 3 mm.

The application assembly also has a cap 30 intended to protect the application component when the assembly is not being used.

In order to use the application assembly of the invention, the user removes the cap 30 from the container and then exerts pressure or presses on the upper surface 18 of the porous dome 16. The application component 14 tilts or is depressed (depending on the type of valve used) and causes the valve to open by tilting or depression of the valve 10 rod 12. The product then diffuses into the region 26 of the porous dome 16 and spreads over its upper surface 18. Some product remains in the porous dome 16, even if the product present on the outer surface 18 has been applied to the surface to be treated.

When the user actuates the application component a second time, a further quantity of product will emerge from the valve rod 12 and will press through the product already present in the porous dome 16. The part 27 then prevents the product from being sent towards the lateral surface 22 of the dome and directs it towards the outer application surface 18. The radial diffusion of the product in the application component is thus limited by this part 27. By virtue of this device, the dome remains clean after several uses and the container is not soiled by the product flowing off.

The device of the invention therefore makes it possible to keep such an assembly clean by preventing the drips of the product occurring during repeated use.

Figure 2:
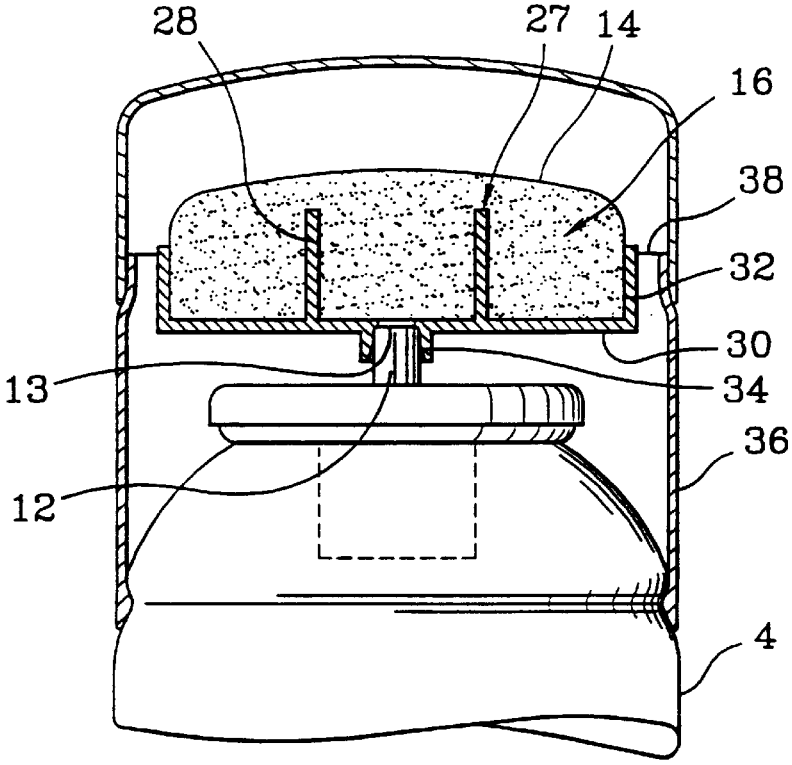
FIG. 2 is a section, similar to FIG. 1, of a second embodiment of an application assembly according to the invention.

In FIG. 2, elements which are identical or fulfill functions similar to elements already described are denoted by the same numerical references. The description of them will not be repeated or will be given in brief.

FIG. 2 shows an application assembly which differs from the one in FIG. 1 by the fact that the porous dome 16 of the application component 14 is held forcibly in an axisymmetric support 30 which is provided with a peripheral skirt 32 and with a central adapter 34. The free end 13 of the valve rod 12 is forcibly engaged in the adapter 34. The support 30 is connected by its peripheral skirt 32 to a collar 36 fixed onto the container 4, connection being made by flexible tongues 38. This connection allows flexible actuation of the application component 14 and provides the user with a feeling of comfort. Of course, this arrangement can be used in the application assembly in FIG. 1.

Furthermore, the wall 28 is secured to the support 30, which allows manufacture of the application component to be facilitated by reducing the number of parts required to produce it.

Figure 3:
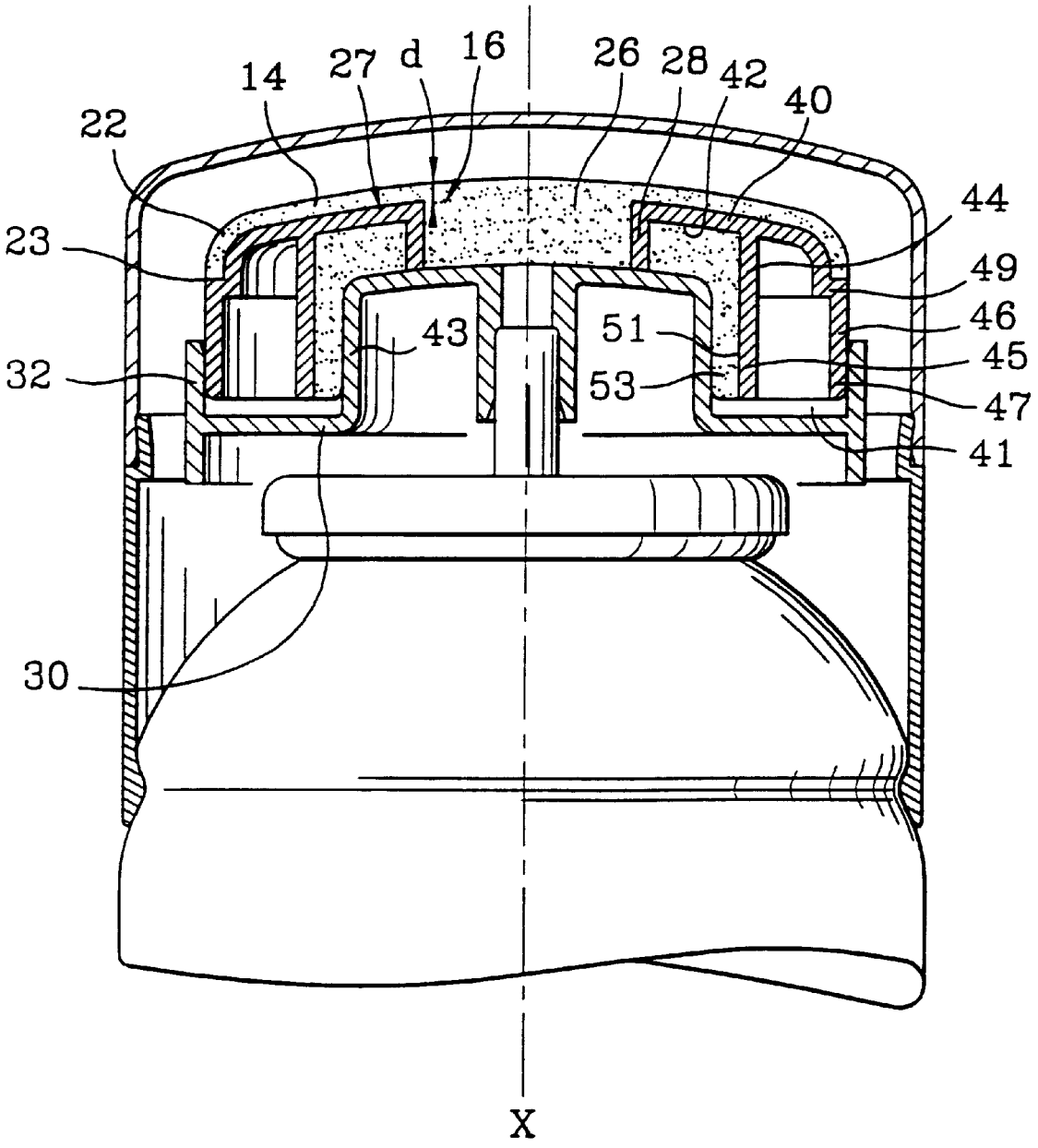
FIG. 3 is a section, similar to FIG. 1, of a third embodiment of an application assembly according to the invention.

Referring to FIG. 3, another alternative embodiment of the application assembly according to the invention is shown. The differences relate essentially to the shape of the part 27 which limits the radial diffusion of the product in the application component.

Thus, this part 27 comprises a wall 28 which surrounds the region 26 of the dome and which is radially extended, in its upper portion, by a plate 40 extending towards the lateral surface 22 of the dome 16. This plate 40 is substantially contained in a plane perpendicular to the axis X. On its lower face 42, it includes a first, inner holding skirt 44 and a second, outer holding skirt 46, which are coaxial with the wall 28. The wall 28 and the plate 40 are embedded in the porous dome 16, and the inner skirt 44 bounds the porous dome under the plate. However, this inner skirt could have been embedded in the sintered material.

The support 30 of the application component 14 includes an annular groove 41 provided with a central wall 43. The free ends 45, 47 of the first and second skirts 44, 46 are accommodated in the annular groove 41. The outer skirt 46 is in internal contact with the peripheral skirt 32 of the support 30 and includes a shoulder 49 on which the lower end 23 of the lateral surface 22 of the dome 16 bears. On its inner face 51, the first skirt 44 is in contact with a portion 53 of the dome which bears on the central wall 43 of the annular groove 41.

Figure 4:
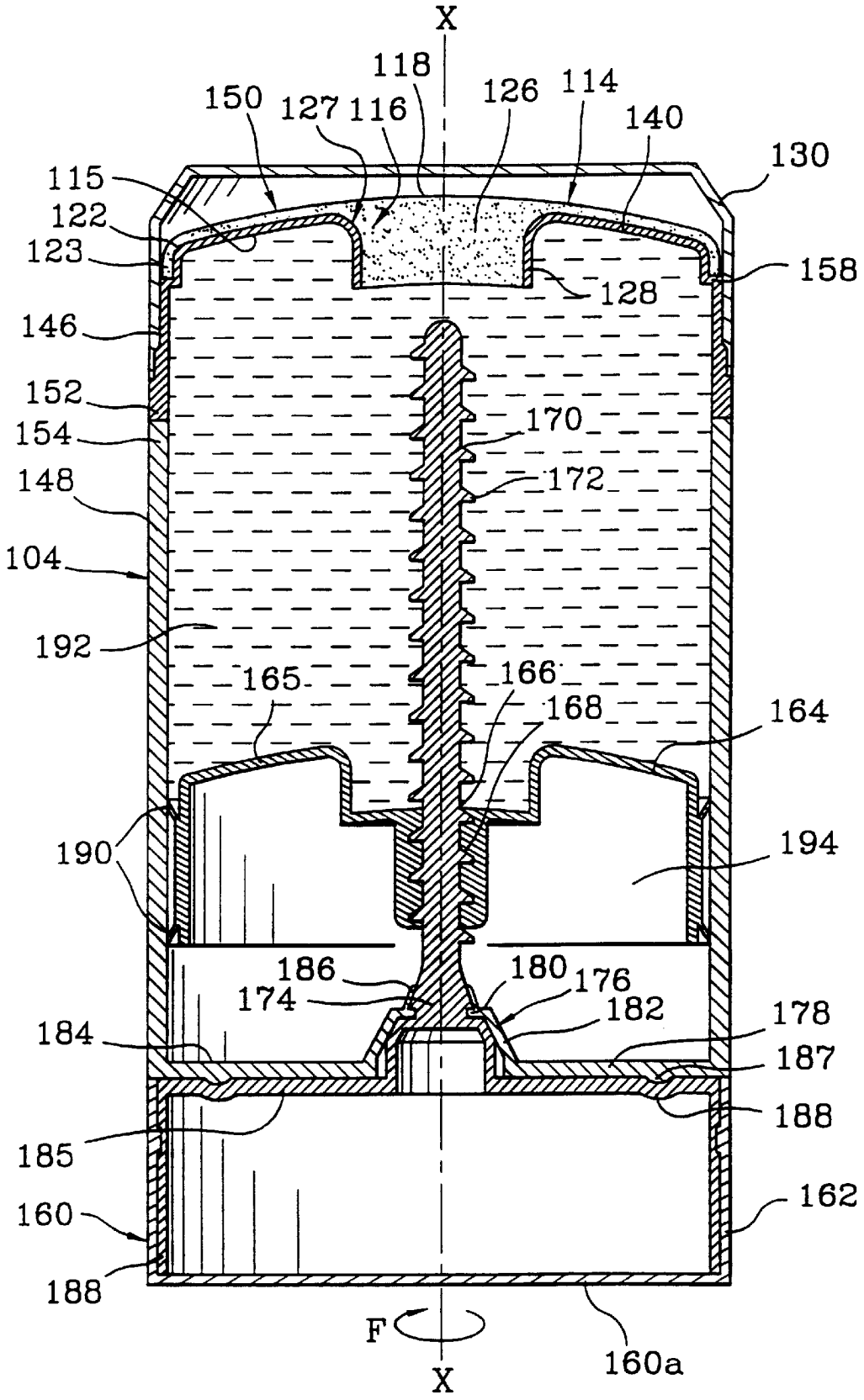
FIG. 4 is an axial section of a fourth embodiment of an application assembly according to the invention.

FIG. 4 represents an alternative embodiment of the invention; elements which are identical or fulfil similar functions to elements already described with reference to the previous figures are denoted by the same references augmented by one hundred. Their description will not be repeated, or will be given in brief. The differences relate to the means for compressing the product, which are of the mechanical type.

Thus, the container 104 comprises a cylindrical body 148 which has a longitudinal axis X and contains the product which preferably has a thick consistency, such as a deodorant gel. The cross-section of the body 148 perpendicular to the axis X may be circular or oval. At one of its ends, the cylindrical body 148 includes a dispensing head 150. This head 150 comprises an application component 114 which includes a porous dome 116 made of sintered material and provided with an application surface 118 which is slightly curved, convexly outwards. The dome 116 also includes a region 126 in communication with the product outlet of the container 104, i.e., with that end of the body 148 which carries the dispensing head 150. The region 126 is bounded by a part 127 comprising a wall 128 in the form of a cylinder centered on the axis X, which is radially extended in its upper portion by a plate 140. This plate 140 extends as far as the lateral surface 122 of the dome 116, and ends in a skirt 146 whose lower end 152 is fixed to the upper edge 154 of the container 104. The lower end 123 of the lateral surface 122 of the dome 116 rests on a shoulder 158 of the skirt 146. The part 127 is fixed onto the cylindrical body 148 of the container 104. As before, the plate is located at a certain distance d from the application surface 118.

The dispensing head 150 is covered by a cap 130 which is fixed onto the skirt 146.

The second end of the body 148,i.e., the end opposite the application component 114, includes an actuation element 160 in the form of an elongate handle having the same cross-section as the body 148, this handle being mounted so as to pivot about the axis X of the assembly.

The lateral wall 162 of the actuation element 160 serves as a gripping surface which is accessible over the entire periphery of the element 160. A user can thus grip the element 160 and rotate it about the axis X, as symbolically represented in FIG. 4 by the arrow F.

Furthermore, the body 148 internally includes a piston 164 whose cross-section corresponds precisely to the internal cross-section of the body 148. At its center, this piston 164 includes an orifice 166 which is tapped 168 and through which a rod 170 provided with a screw thread 172 and with a frustoconical head 174 passes. This rod 170 is mounted so that it can rotate freely about the axis X of the assembly, while being immobilized axially, by virtue of a frustoconical shoulder 176 of the base 178. This shoulder 176 includes an orifice 180 extended by a frustoconical surface 182 which is connected to a plane portion 184 of the base 178; it thus has a suitable shape for accommodating the frustoconical head 174 of the rod 170 and holds the rod 170 axially.

The shoulder 176 is extended by an elastic sleeve 186, in order to seal off the interior of the container 104 from the outside, thus preventing any penetration of ambient air which could dry out or degrade the product which is packaged.

The head 174 of the rod 170 is secured to the actuation element 160. Specifically, this head is connected to a plate 185 whose edges 188 are connected to the lateral wall 162 of the actuation element 160. The base of the element 160 is closed by a plate 160*a*.

The plane part 184 of the base 178, and the plate 185, are provided with systems consisting of protuberances 187 and hollow parts 188, which are arranged opposite each other and interact with each other, this system allowing the user to reposition the actuation element 160 in extension of the (non-circular) body 148.

Furthermore, the piston 164 has an upper face 165 which is in contact with the product to be dispensed and whose shape is complementary with the shape of the lower face 115 of the application component 114. At its periphery, the piston 164 also includes lip seals 190 which bear forcefully against the inner lateral wall of the body 148 and thus make a perfect seal between the volume 192 of the container containing the product to be dispensed and the volume 194 defined between the piston 164 and the base 178.

In order to use the application assembly, the user removes the cap 130 from the container then pivots the actuation element 160 in the direction of the arrow F. The rotation of this element 160 leads to rotation of the rod 170 and generates an axial displacement of the piston 164, the effect of which is to press the product through the dome 114. The region 126 of the dome is thus firstly impregnated with product. The part 127 then directs the product towards the outer application surface 118 and prevents it from being sent towards the lateral surface 122 of the dome 114.

Such an arrangement of the application component prevents there from being an excessive quantity of product on the outer surface 118 of the dome. First, after the product has been applied to the surface to be treated, the application component no longer includes an accumulation of excess product and therefore remains clean.

What is claimed is:

1. An assembly for the application of a product, comprising:

a container containing a product to be dispensed and provided with an outlet for the product;

an application component for applying the product, said application component having an application surface, a peripheral edge and a region in communication with the product outlet of the container;

a part separate from the application component, which limits diffusion of the product in the application component in a direction toward the peripheral edge, said part being located between said region and the peripheral edge of the application component, wherein said part which limits diffusion of the product in the application component comprises a wall around the region in communication with the container, and wherein an upper portion of the wall extends to adjacent the application surface such that the application component includes a region radially bounded by said wall to thereby limit the diffusion of the product toward the peripheral edge.

2. The application assembly according to claim 1, wherein an upper portion of the wall is radially extended relative to an axis of the container by a plate which extends towards the peripheral edge of the application component.

3. The application assembly according to claim 2, wherein the plate is in proximity to the application surface.

4. The application assembly according to claim 2, wherein a lower portion of the plate includes at least one holding skirt.

5. The application assembly according to claim 1, wherein a minimum distance between said part and said application surface is no greater than 5 mm.

6. The application assembly according to claim 1, including means for compressing the product to produce a sufficient pressure on the product to press the product through the application component.

7. The application assembly according to claim 6, wherein said compression means includes a piston and means for operating the piston.

8. The application assembly according to claim 7, wherein said operating means comprise a rod having a screw thread and secured to an actuation element, the screw thread of the rod interacting with a complementary screw thread of the piston.

9. The application assembly according to claim 6, wherein said compressing means include a propellent gas and a dispensing valve provided with a hollow valve rod which interacts with the application component.

10. The application assembly according to claim 9, wherein said application component is mounted directly onto the hollow valve rod.

11. The application assembly according to claim 1 wherein said application component is carried by a support.

12. The application assembly according to claim 11, wherein said part is secured to the support.

13. The application assembly according to claim 1 wherein said application component is a sintered part.

14. The applicator assembly of claim 1 wherein said product is a deodorant.

15. The application assembly according to claim 1, wherein the container includes a collar, including means for connecting the application component to said collar.

16. The application assembly according to claim 1, wherein said part is fixed onto the container.

* * * * *